US006092286A

United States Patent [19]

Lange

[11] Patent Number: 6,092,286

[45] Date of Patent: Jul. 25, 2000

[54] METHOD TO FABRICATE WIRES AND WIRE FABRICATED THEREBY

[76] Inventor: Werner Lange, Johann-Reiter-Strasse 12, D-89564 Nattheim-Auernheim, Germany

[21] Appl. No.: 08/921,090

[22] Filed: Aug. 29, 1997

[30] Foreign Application Priority Data

Aug. 30, 1996 [DE] Germany ..... 196 35 189

[51] Int. Cl.[7] ..... B23P 15/16

[52] U.S. Cl. ..... 29/896.62; 29/505

[58] Field of Search ..... 29/505, 509, 521, 29/902, 896.62; 210/294, 295, 232, 323.1

[56] References Cited

U.S. PATENT DOCUMENTS

| | | | |
|---|---|---|---|
| 2,423,442 | 7/1947 | Dustan . | |
| 2,588,533 | 3/1952 | Johnson . | |
| 4,828,689 | 5/1989 | Lamort | 210/232 |
| 5,011,065 | 4/1991 | Musselman | 29/163.6 |
| 5,047,148 | 9/1991 | Arai | 210/498 |
| 5,090,721 | 2/1992 | Lange | 220/485 |
| 5,094,360 | 3/1992 | Lange | 220/485 |
| 5,384,046 | 1/1995 | Lotter et al. | 210/484 |
| 5,387,340 | 2/1995 | Ackerman | 210/497.01 |
| 5,394,600 | 3/1995 | Chen | 29/902 |
| 5,504,987 | 4/1996 | Bergkvist et al. | 29/700 |
| 5,513,757 | 5/1996 | Papetti | 210/498 |
| 5,727,316 | 3/1998 | Riendeau | 29/896.62 |
| 5,768,783 | 5/1998 | Lange | 29/896.62 |

FOREIGN PATENT DOCUMENTS

| | | |
|---|---|---|
| 0167999 | 7/1985 | European Pat. Off. . |
| 417 408 | 3/1991 | European Pat. Off. . |
| 33 07 916 | 9/1984 | Germany . |
| 43 03 892 | 8/1994 | Germany . |
| 44 35 538 | 4/1996 | Germany . |

*Primary Examiner*—David P. Bryant
*Assistant Examiner*—Jermie E. Cozart
*Attorney, Agent, or Firm*—Baker & Daniels

[57] ABSTRACT

Manufactured by the method are screens provided with screening holes (7). For that purpose, a screen is composed of a plurality of screen strips (2) which, together with profile bars (1), are aligned parallel to one another and positively joined to one another and to at least two transverse beams (3). Screens manufactured in this manner are used in the paper industry as screen baskets.

16 Claims, 2 Drawing Sheets

METHOD TO FABRICATE WIRES AND WIRE FABRICATED THEREBY

Figure 1:
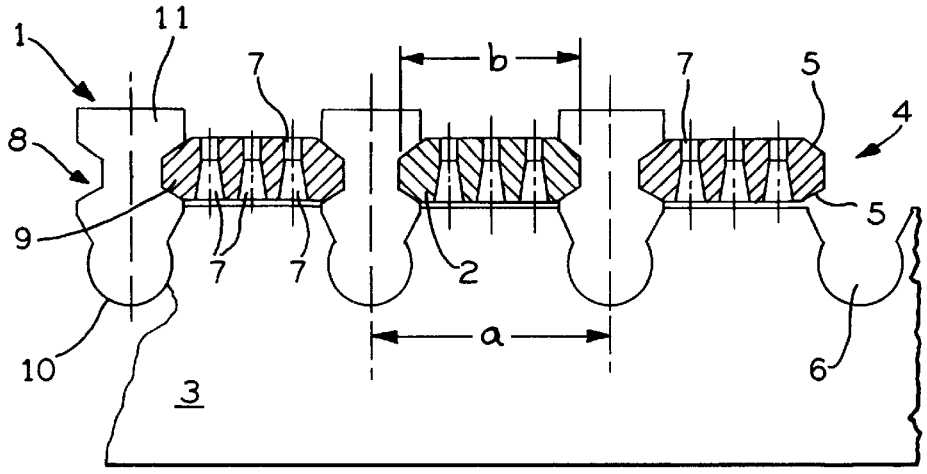

The invention relates to a method of manufacturing screens for the pulp and paper industry.

A screen made thereby, e.g., may be a screen basket such as used in pressure screens in the pulp and paper industry for treating the fibrous suspension by sort of an after-screening. The procedure aims in most cases to retain nonfiber contaminations on account of their size on a screen element and remove them thereafter, allowing the fibers to pass along with part of the water through the screening holes. There are also other applications for such apparatuses, for example, fractionating fibrous suspensions by fiber length or also, e.g., to allow undesirable pulverized substances to pass the screen element while retaining the fibers. Basically, such machines are popular and employed frequently. The screen element inserts are called screen baskets when having a rotationally symmetric, i.e., cylindrical structure. To prevent hole plugging, scrapers are mostly used that pass in close proximity. Screens made by the method according to the invention may be used also outside the pulp and paper industry.

It may be assumed that such machines and the screens used therein normally satisfy their purpose. As customary everywhere in the industry, however, the economy of such separating processes is considered very important, for which reason repeated attempts have been made at making the screens—which may be viewed also as wear parts—less expensive. Such screens, in fact, are rather expensive objects which often need to be replaced at certain intervals. Therefore, the particular endeavor of the manufacturers of such screens is directed at their maximally low-cost manufacture.

As generally known, there are different hole forms in use for the screens. A differentiation is made between essentially round holes and oblong holes, the latter being in the extreme case slots which extend across the entire axial expanse of the screen baskets. The manufacturing methods are adapted to the screening holes, differ therefore often considerably for hole type screen baskets and slotted screen baskets. For slotted screen baskets, modern manufacturing methods have already been found in which the openings, i.e., the slots, are formed between parallel bars. Nonetheless, this method continues to be very expensive, due to the great number of bars.

In hole type screens, the screening holes are normally introduced in a plate with the use of known methods, for example drilling or electron discharge machining. In special cases, perforated plates are used. Although automatic machines made it possible to automate the production sequences, notably of drilling mills, production still is rather expensive.

The objective underlying the invention is to provide a screen manufacturing method that allows reducing the cost without impairing the quality. Furthermore, also the expense of producing screens of different size should be low.

This objective is satisfied by the features as set forth and described hereinbelow.

Such screen strips are easier to drill than complete screen plates, since they are narrower, and allow easy machining on a relatively small drilling machine. A high degree of automation is possible in the manufacture and assembly of the components. Owing to the supporting profile bars, they may in many cases have a wall thickness smaller than perforated screens or screen shells made of one piece. Important is also that, depending on throughput requirements and size, flat screens or screen baskets of different size are required in practice. While prior-art screen baskets of different size require large and expensive manufacturing systems, the inventional method allows manufacturing on the same system screen baskets of different diameter and different height. The same is true also for flat screens of different size.

Manufacturing screen baskets or screen shells by the inventional methods makes the difficult bending of perforated, large-area screen plates dispensable, due to composing them of several screen strips, which bending may lead to an insufficiently precise screen basket manufacture.

Figure 2:
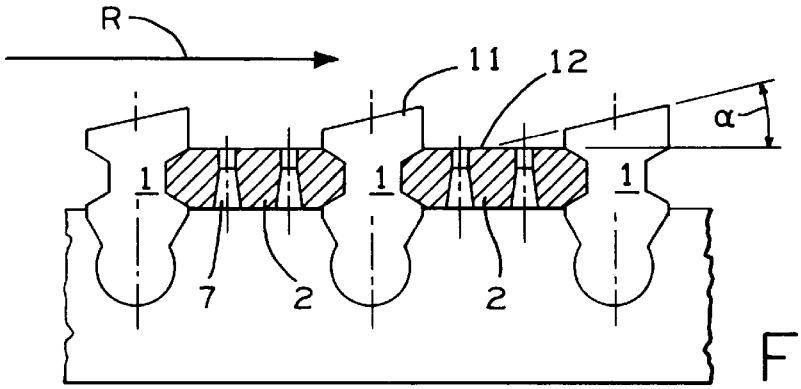
Figure 3:
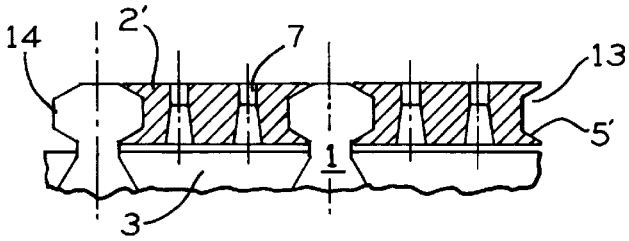
Figure 5:
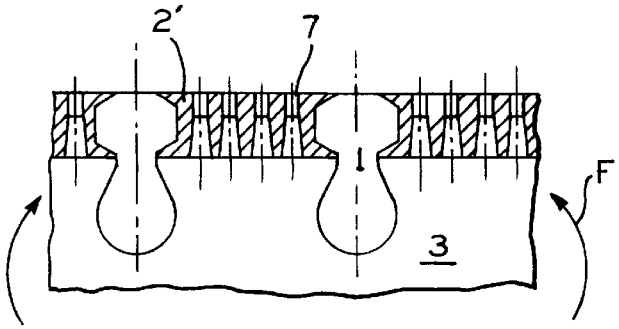
Figure 4:
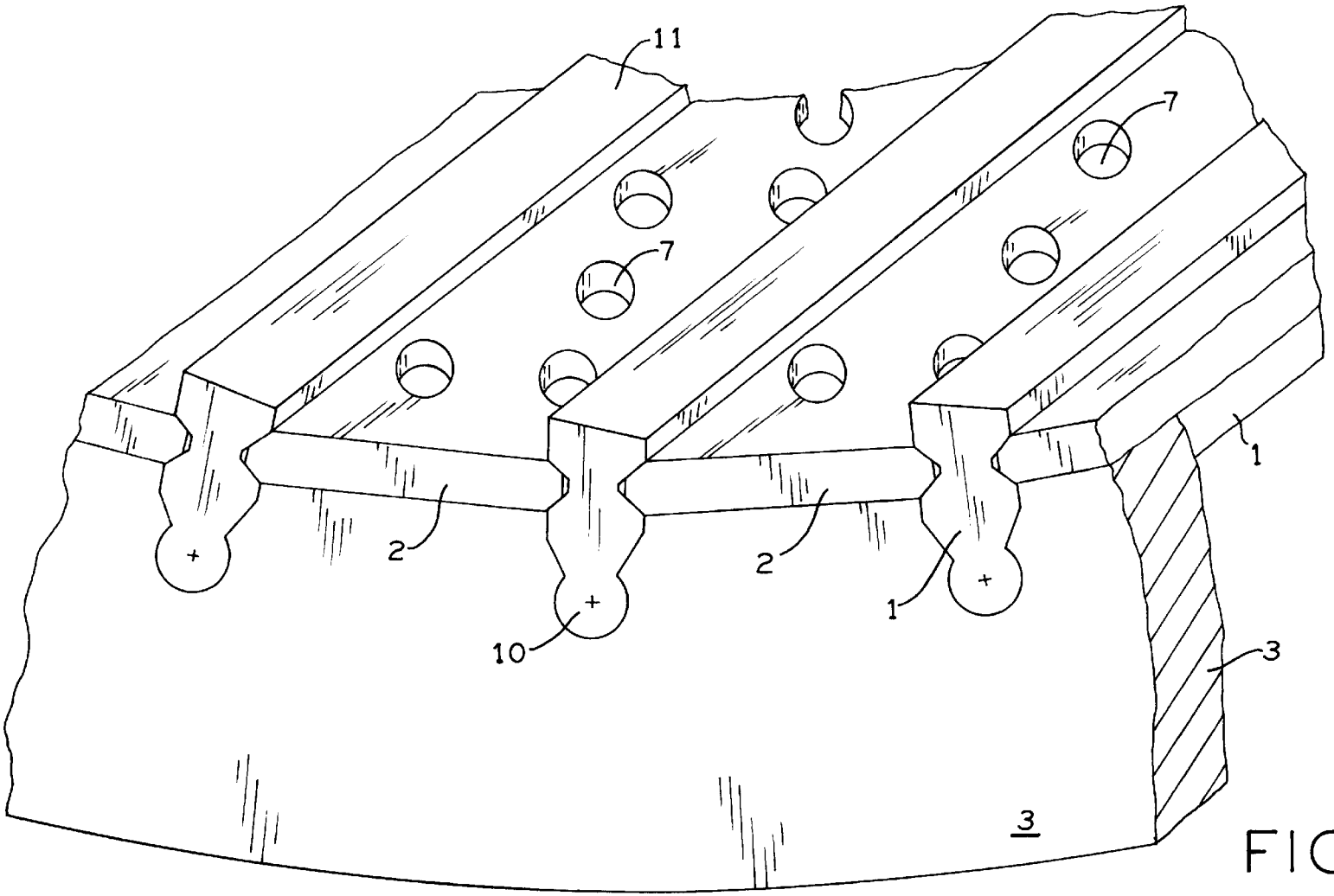

The invention and its advantages are illustrated with the aid of drawings, showing in:

FIG. 1, part of an inventionally manufactured screen during manufacture;

FIGS. 2–3, variants with different profile bars;

FIG. 4, a perspective view of part of an inventionally manufactured screen after deformation;

FIG. 5, a partial view of a flat screen made using the method.

FIG. 1 shows the components needed for the manufacture of the inventional screen already assembled, but before the deformation step. Visible are screen strips 2 provided already with screening holes 7 tapering here, e.g., from top to bottom, in keeping with the intended direction of flow. Other hole forms, of course, are conceivable as well. The screen strips 2 contain on their length sides 4 form surfaces 5 across their longitudinal expanse. These are bevels contained on side protrusions 9 on the screen strips. The profile bars 1 contain on both sides opposing grooves 8 which essentially are complementary to the said form surfaces 5 of the screen strips 2, enabling a joint between the screen strips and profile bars. The profile bars 1, in turn, are provided with an assembly contour 10—pictured here at the bottom—and feature elevations 11 on the end 10, the top end, opposite the assembly contour. Pictured here in part, the one beam 3 has upwardly open recesses 6 introduced at intervals a. The profile bars 1 are anchored in said recesses 6 with the aid of their assembly contour 10. The interval a and the width b of the screen strips 2 are selected such that an intimate bond is created between screen strips and profile bars.

FIG. 2 shows a variant in which the profile bars 1 feature on their top end opposite the assembly contour 10 an elevation 11 whose top edge is slanted and assumes an angle $\alpha$ relative to the top side 12 of the adjoining screen strip. The top side of the profile bar and the top side 12 of screen strip are disposed suitably on the scraper side of the screen, scraper side meaning the side on which—as initially mentioned—a scraper sweeps across. Such slanting surfaces increase in conjunction with the scraper and the flow of the suspension the turbulence, which mostly favors keeping the screening holes open. The inclination is normally chosen such that, viewed in the direction of scraper motion (arrow R), it deflects the flow away from the surface of the screen strips. In the example shown in FIG. 2, a screen strip—viewed in cross direction—contains two rows of screening holes. The number of such rows provided in the cross direction of the screen strips depends on the future conditions of service at which the inventionally made screen is to be used.

The top side design on the profile bars 1 depends on the conditions of screen use. As previously mentioned, measures on the top side can lead to desirable turbulences that improve the function of the screen. Therefore, said profile bars assume both a support function for the screen strips and also a hydraulic function, notably due to the top side design options. Conceivable are cases in which the top part is kept as small as possible, so that it essentially adapts to the top edge of the screen. To that end, design options are available in the framework of the invention. For example, the geometry of assembly may also, but need not, be reversed, as shown in FIG. 3, such that the screen strips 2' contain grooves 13, while the profile bars 1' contain protrusions 14.

FIG. 4 shows perspectively, in partial view, an embodiment of an inventionally manufactured arcuate screen. It may belong to a screen shell or a screen cylinder (screen basket). With the deformation step required for the manufacture of the screen completed, the final arcuate form is visible.

FIG. 5 resembles in some respects FIG. 3, but, unlike it, illustrates the finished screen. Profile bars 1, screen strips 2 and beams 3 are positively joined by internal stresses (arrows F), with the form of a flat screen having formed here.

Not illustrated expressly are measures such by which additional connections are made on the contact surfaces by soldering, gluing or welding. The expert is familiar with the measures as such. In difficult applications, the strength of the screen can be increased further thereby.

The screen described above is suited notably for assembly of a screen for use in screening pulp suspensions, where screen strips (2) alternate, viewed in peripheral direction, with profile bars (1);

the screen strips (2) have a plurality of screening holes (7), and the profile bars (1) protrude beyond the swept surface of the screen strip (2).

I claim:

1. A method for the manufacture of screens featuring a plurality of screening holes comprising the following steps:

providing screen strips with screening holes therethrough, said screen strips having form surfaces provided on length sides wherein the form surfaces are identical across their longitudinal expanse;

providing at least two beams wherein each beam includes a side provided, at a specific interval, with recesses open toward this side;

providing profile bars whose profile has on one side an assembly contour which essentially is complementary to the recesses in the beams and, additionally, each profile bar has a pair of opposite sides including grooves or protrusions which at least partly are complementary to the form surfaces of the screen strips;

inserting the profile bars, parallel to one another, in the recesses in the beams;

inserting the screen strips, parallel to one another, between the profile bars; and deforming the beams into a final form, the inserted profile bars being positively clamped by the deformation.

2. The method according to claim 1, wherein the recesses in the beams have the same specific interval throughout, and the screen strips have the same width throughout.

3. The method according to claim 1, wherein the profile of the profile bars features, on a top side, opposite the side including the assembly contour, an elevation protruding beyond the groove or the protrusion.

4. The method according to claim 3, wherein the elevation, viewed in a direction of scraper motion (R), slants relative to a top side of the screen strips at an angle $\alpha$ between 0 and 30°.

5. The method according to claim 1, wherein the form surfaces on the sides of the screen strips include protrusions and the profile bars include grooves that are complementary thereto.

6. The method according to claim 1, wherein the form surfaces of the screen strips include grooves and the profile bars include protrusions that are complementary thereto.

7. The method according to claim 1, wherein the screen strips, viewed in their cross direction, include a plurality of rows of screening holes therethrough.

8. The method according to claim 7, wherein the screen strips, viewed in their cross direction, each includes only one row of screening holes.

9. The method according to claim 1, wherein the beams are bent to annular segments by plastic deformation.

10. The method according to claim 1, wherein the beams are bent to self-contained rings by plastic deformation.

11. The method according to claim 10, wherein the contact surfaces of the beams and the profile bars are joined to one another nondetachably.

12. The method according to claim 9, wherein the centerline of curvature lies in the deformation of the beams on the length sides of the screen strips.

13. The method according to claim 1, wherein the beams are deformed by elastic back deformation and brought to a final form, after assembly of the beams, screen strips and profile bars.

14. The method according to claim 1, wherein the screening holes are holes with a diameter between 1 and 6 mm.

15. The method according to claim 1, wherein a clamping joint is created also between the form surfaces of the screen strips and the profile bars, by deformation of the beams.

16. The method according to claim 15, wherein at least part of the clamping joint is reinforced additionally by a nondetachable joint.

* * * * *